US008851089B1

(12) United States Patent
Rogers

(10) Patent No.: US 8,851,089 B1
(45) Date of Patent: Oct. 7, 2014

(54) EXPANDABLE TRAVEL BAG SYSTEM

(71) Applicant: Lia M. Rogers, Massapequa, NY (US)

(72) Inventor: Lia M. Rogers, Massapequa, NY (US)

( * ) Notice: Subject to any disclaimer, the term of this patent is extended or adjusted under 35 U.S.C. 154(b) by 0 days.

(21) Appl. No.: 14/094,918

(22) Filed: Dec. 3, 2013

(51) Int. Cl.
*A45D 40/00* (2006.01)
*A45C 11/26* (2006.01)
*A45C 11/00* (2006.01)

(52) U.S. Cl.
CPC ..... *A45C 11/26* (2013.01); *A45C 11/008* (2013.01)
USPC ..... 132/312; 190/107; 190/109

(58) Field of Classification Search
CPC ..... A45D 27/22; A45D 27/26; A45D 27/29; A45C 3/00; A45C 3/001; A45C 5/00
USPC ..... 132/312, 286; 190/107, 109, 110; 206/287.1
See application file for complete search history.

(56) References Cited

U.S. PATENT DOCUMENTS

| | | | | |
|---|---|---|---|---|
| 4,464,835 | A | | 8/1984 | Bowman et al. |
| 4,738,547 | A | * | 4/1988 | Brown ..... 383/39 |
| 4,850,730 | A | | 7/1989 | Jimenez et al. |
| 5,524,778 | A | | 6/1996 | De Caluwe et al. |
| 5,679,421 | A | | 10/1997 | Brinton, Jr. |
| 6,935,783 | B2 | | 8/2005 | Carter |
| D564,218 | S | | 3/2008 | Bagus |
| 7,617,828 | B1 | | 11/2009 | Sinha |
| D641,547 | S | | 7/2011 | Coleman |
| 2004/0222125 | A1 | | 11/2004 | Meing |

* cited by examiner

*Primary Examiner* — Rachel Steitz

(57) ABSTRACT

An expandable travel bag system to aid in organizing toiletries when travelling features a flexible, planar anterior bag panel. A pair of item holding straps is located on an anterior bag panel front surface. An attachment strap is located on an anterior bag panel rear surface. The system features a posterior bag panel. A pair of item holding straps is located on a posterior bag panel front surface. An attachment pad is located on a posterior bag panel rear surface. The anterior bag panel is attached to the posterior bag panel via a second anterior hook and loop component attached to a first posterior hook and loop component. The anterior bag panel and the posterior bag panel are flexibly rolled into a cylindrical form for transport and held into a rolled up position via the attachment strap attached to the attachment pad.

16 Claims, 7 Drawing Sheets

(ISO View)

(Front View)

(Back View)

EXPANDABLE TRAVEL BAG SYSTEM

FIELD OF THE INVENTION

The present invention relates to toiletry bags and kits.

BACKGROUND OF THE INVENTION

Travel bags have been around for hundreds of years for carrying many different types of items. When carrying toiletries, however, there are certain issues that must be addressed including making sure nothing is left behind, ensuring no liquid leaks, and the space used is kept to a minimum. Many times, a sealable plastic bag has been used for carrying toiletries. The present invention features an expandable travel bag system to aid in organizing toiletries when travelling.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

The present invention features an expandable travel bag system to aid in organizing toiletries when travelling. In some embodiments, the system comprises a flexible, planar anterior bag panel. In some embodiments, a first anterior flap is located on the anterior bag panel top edge. In some embodiments, a second anterior flap is located on the anterior bag panel bottom edge.

In some embodiments, a first anterior hook and loop component is located on the entire anterior bag panel first edge. In some embodiments, a mated second anterior hook and loop component is located on the entire anterior bag panel second edge.

In some embodiments, a pair of item holding straps is located on the anterior bag panel front surface. In some embodiments, the holding straps are located only in pairs only on an axis parallel to the anterior bag panel first edge and the anterior bag panel second edge on the anterior bag panel front surface.

In some embodiments, an attachment strap is located on the anterior bag panel rear surface. In some embodiments, the attachment strap comprises a first hook and loop component located thereon.

In some embodiments, the system comprises a posterior bag panel. In some embodiments, a first posterior flap is located on the posterior bag panel top edge. In some embodiments, a second posterior flap is located on the posterior bag panel bottom edge.

In some embodiments, a first posterior hook and loop component is located on the entire posterior bag panel first edge. In some embodiments, a mated second posterior hook and loop component is located on the entire posterior bag panel second edge.

In some embodiments, a pair of item holding straps is located on the posterior bag panel front surface. In some embodiments, the holding straps are located only in pairs only on an axis parallel to the posterior bag panel first edge and the posterior bag panel second edge on the posterior bag panel front surface, In some embodiments, an attachment pad is located on the posterior bag panel rear surface. In some embodiments, the attachment pad comprises a mated second hook and loop component located thereon.

In some embodiments, the anterior bag panel is located on the posterior bag panel via the second anterior hook and loop component attached to the first posterior hook and loop component. In some embodiments, the anterior bag panel and the posterior bag panel are flexibly rolled into a cylindrical form for transport. In some embodiments, the anterior bag panel and the posterior bag panel are held into a rolled up position via the attachment strap attached to the attachment pad.

DESCRIPTION OF PREFERRED EMBODIMENTS

Figure 1:
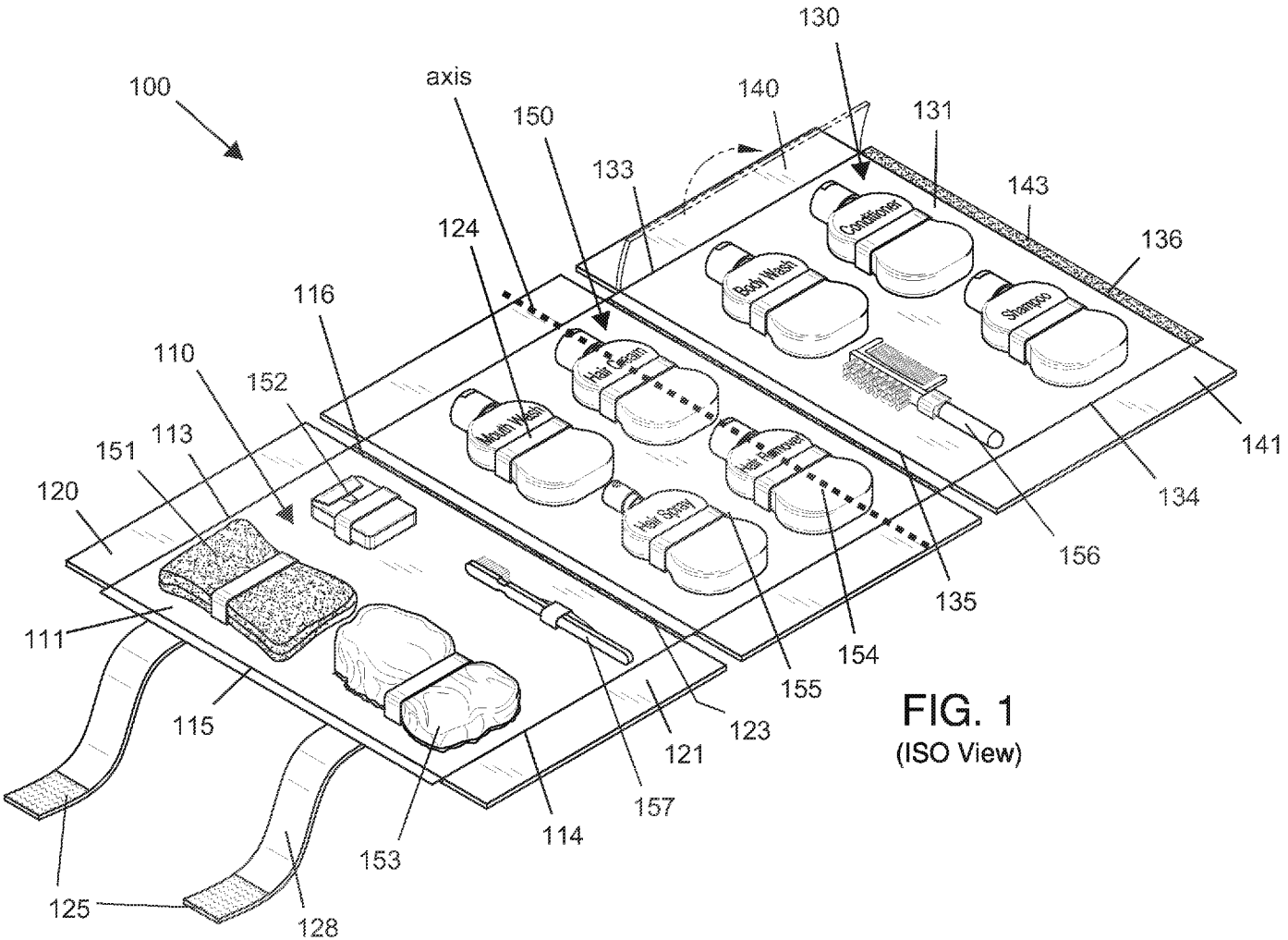
FIG. 1 shows a perspective view of the present invention.

Following is a list of elements corresponding to a particular element referred to herein:

100 Travel bag system
110 Anterior bag panel
111 Anterior bag panel front surface
112 Anterior bag panel rear surface
113 Anterior bag panel top edge
114 Anterior bag panel bottom edge
115 Anterior bag panel first edge
116 Anterior bag panel second edge
120 First anterior flap
121 Second anterior flap
122 First anterior hook and loop component
123 Second anterior hook and loop component
124 Holding strap
125 First hook and loop component
128 Attachment strap
130 Posterior bag panel
131 Posterior bag panel front surface
132 Posterior bag panel rear surface
133 Posterior bag panel top edge
134 Posterior bag panel bottom edge
135 Posterior bag panel first edge
136 Posterior bag panel second edge
140 First posterior flap
141 Second posterior flap
142 First posterior hook and loop component
143 Second posterior hook and loop component
145 Second hook and loop component
148 Attachment pad
150 Expansion bag panel
151 Wash cloth
152 Dental floss
153 Shower cap
154 Flexible bottle
155 Bottle mid-section
156 Comb and brush
157 Toothbrush

158 Deodorant

159 Razor

Figure 2:
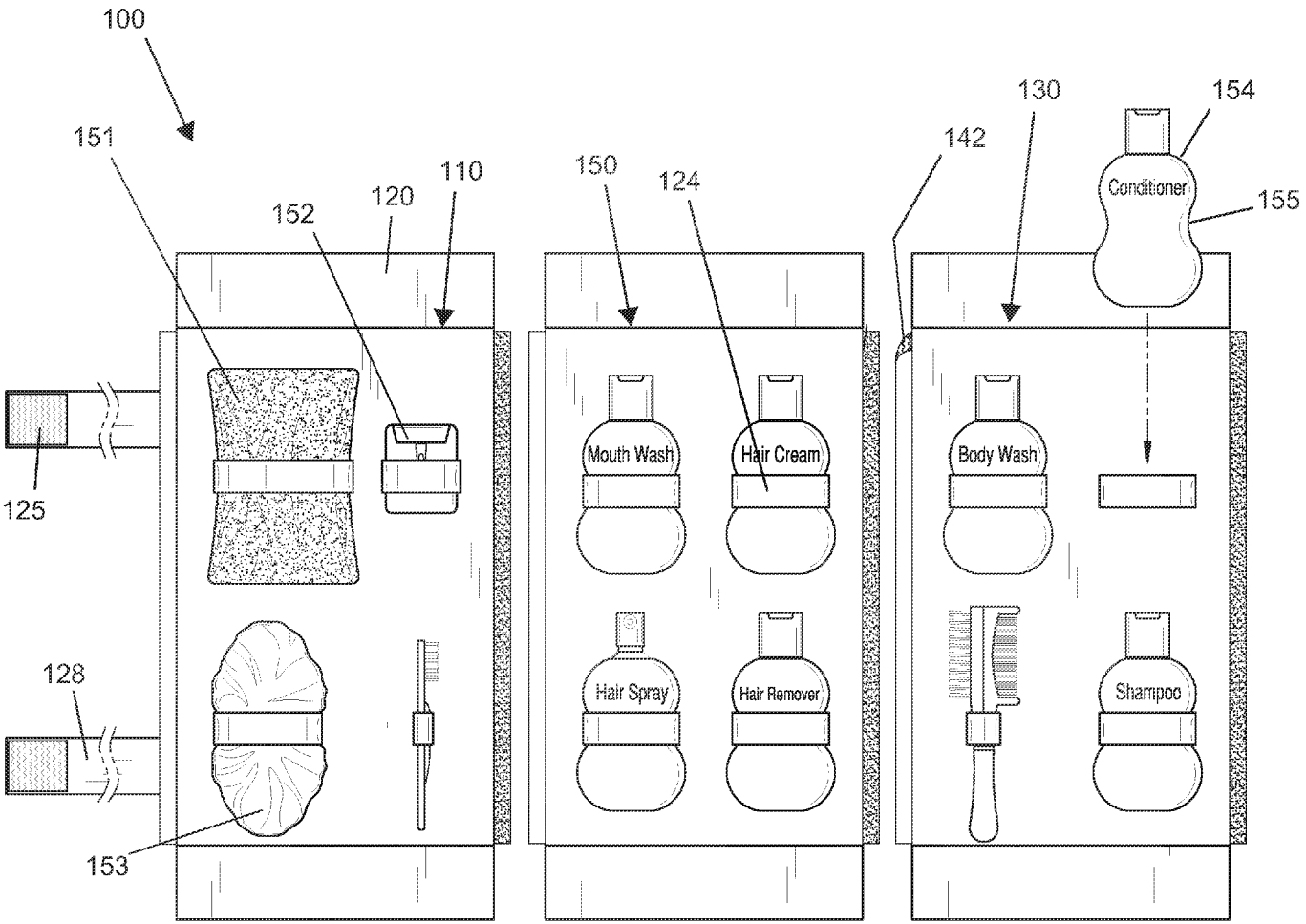
FIG. 2 shows a front view of the present invention.
Figure 3:
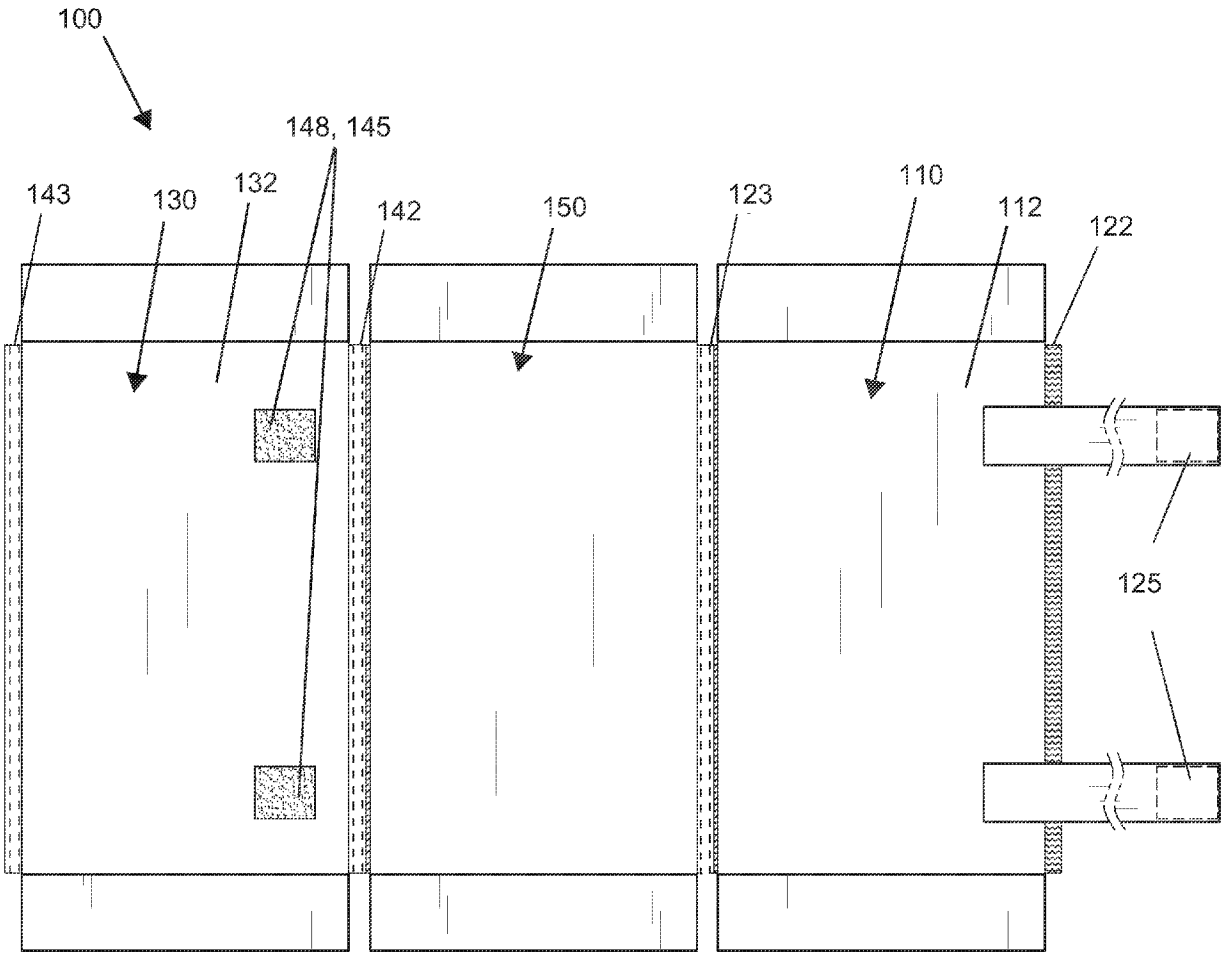
FIG. 3 shows a back view of the present invention.
Figure 4:
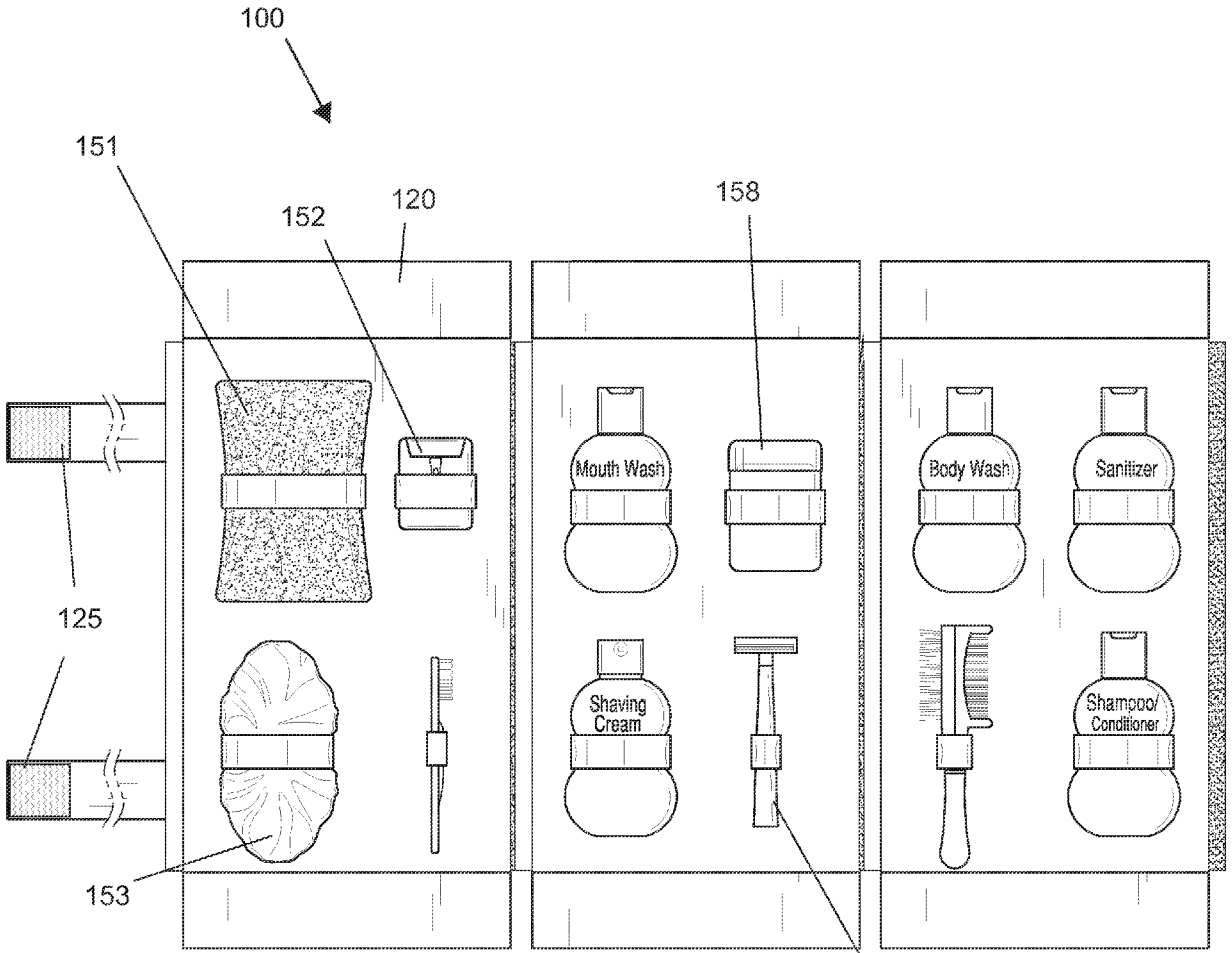
FIG. 4 shows a front view of the present invention.
Figure 5:
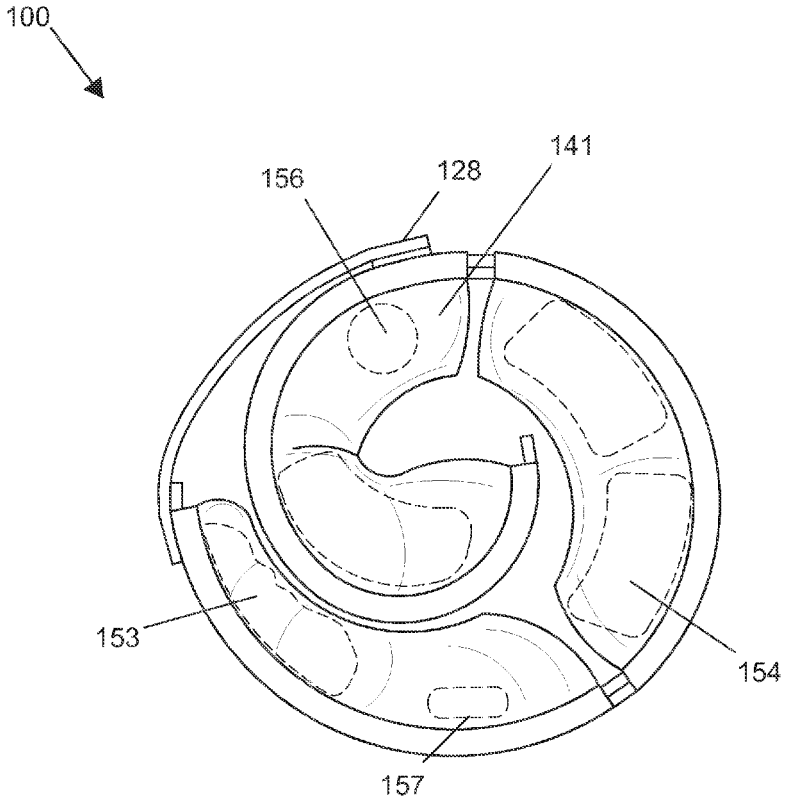
FIG. 5 shows a side view of the present invention.
Figure 6:
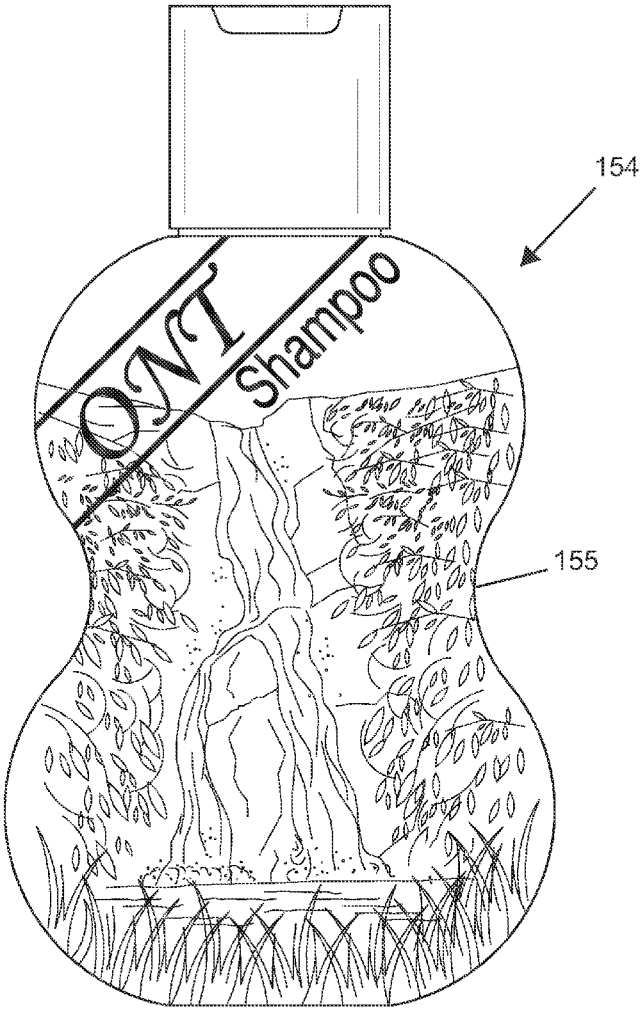
FIG. 6 shows a front view of the flexible bottle of the present invention.
Figure 7:
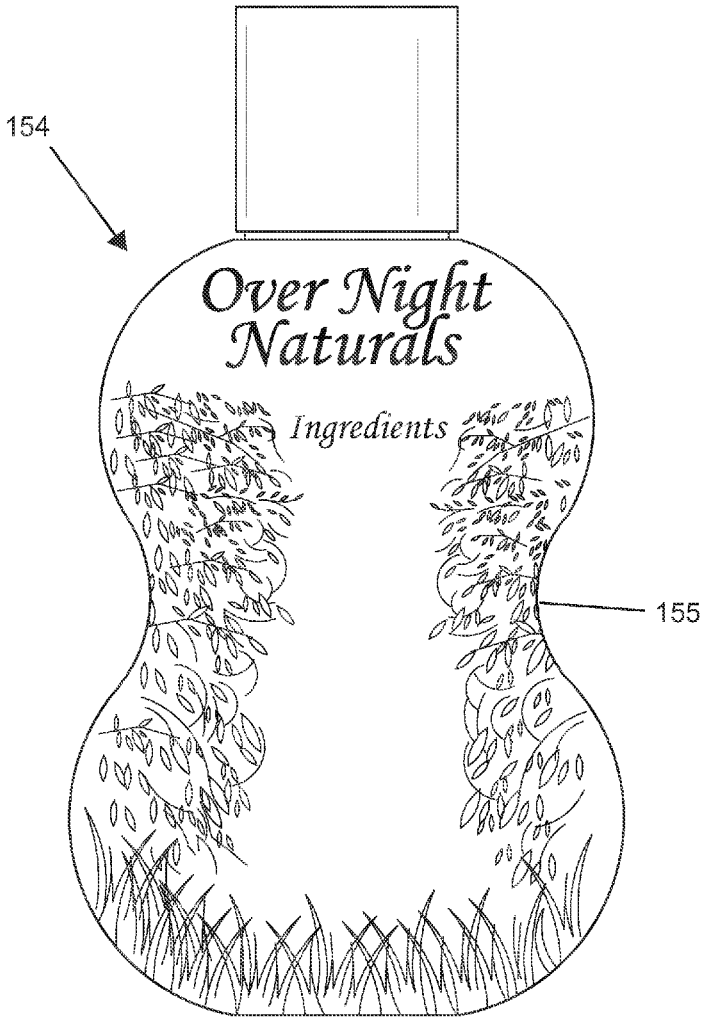
FIG. 7 shows a front view of the flexible bottle of the present invention.

Referring now to FIG. 1-7, the present invention features an expandable travel bag system (100) to aid in organizing toiletries when travelling. In some embodiments, the system (100) comprises a flexible, planar anterior bag panel (110) having an anterior bag panel front surface (111), an anterior bag panel rear surface (112), an anterior bag panel top edge (113), an anterior bag panel bottom edge (114), an anterior bag panel first edge (115), and an anterior bag panel second edge (116).

In some embodiments, a first anterior flap (120) is located on the anterior bag panel top edge (113). In some embodiments, a second anterior flap (121) is located on the anterior bag panel bottom edge (114). In some embodiments the first anterior flap (120) and the second anterior flap (121) help retain contents when the system (100) is rolled.

In some embodiments, a first anterior hook and loop component (122) is located on the entire anterior bag panel first edge (115). In some embodiments, a mated second anterior hook and loop component (123) is located on the entire anterior bag panel second edge (116). In some embodiments, the first anterior hook and loop component (122) and the second anterior hook and loop component (123) are located on a flap that serves as a hinge when connected to the mated hook and loop component.

In some embodiments, a pair of item holding straps (124) is located on the anterior bag panel front surface (111). In some embodiments, the holding straps (124) are located only in pairs only on an axis parallel to the anterior bag panel first edge (115) and the anterior bag panel second edge (116) on the anterior bag panel front surface (111). In some embodiments, this ensures easier rolling of the system (100) for compaction.

In some embodiments, an attachment strap (128) is located on the anterior bag panel rear surface (112). In some embodiments, the attachment strap (128) comprises a first hook and loop component (125) located thereon.

In some embodiments, the system (100) comprises a posterior bag panel (130) having a posterior bag panel front surface (131), a posterior bag panel rear surface (132), a posterior bag panel top edge (133), a posterior bag panel bottom edge (134), a posterior bag panel first edge (135), and a posterior bag panel second edge (136).

In some embodiments, a first posterior flap (140) is located on the posterior bag panel top edge (133). In some embodiments, a second posterior flap (141) is located on the posterior bag panel bottom edge (134). In some embodiments, the first posterior flap (140) and the second posterior flap (141) help keep the contents of the system (100) retained when the system (100) is rolled.

In some embodiments, a first posterior hook and loop component (142) is located on the entire posterior bag panel first edge (135). In some embodiments, a mated second posterior hook and loop component (143) is located on the entire posterior bag panel second edge (136). In some embodiments, the first posterior hook and loop component (142) and the second posterior hook and loop component (143) are located on a flexible flap that serves as a hinge when connected to the mated hook and loop component.

In some embodiments, a pair of item holding straps (124) is located on the posterior bag panel front surface (131). In some embodiments, the holding straps (124) are located only in pairs only on an axis parallel to the posterior bag panel first edge (135) and the posterior bag panel second edge (136) on the posterior bag panel front surface (131). In some embodiments, the item holding straps (124) located on an axis enables easier rolling and compaction of the system (100).

In some embodiments, an attachment pad (148) is located on the posterior bag panel rear surface (132). In some embodiments, the attachment pad (148) comprises a mated second hook and loop component (145) located thereon.

In some embodiments, the anterior bag panel (110) is removably located on the posterior bag panel (130) via the second anterior hook and loop component (123) attached to the first posterior hook and loop component (142). In some embodiments, the anterior bag panel (110) and the posterior bag panel (130) are flexibly rolled into a cylindrical form for transport. In some embodiments, the anterior bag panel (110) and the posterior bag panel (130) are held into a rolled-up position via the attachment strap (128) connecting to the attachment pad (148).

In some embodiments, an expansion bag panel (150) is located between the anterior bag panel (110) and the posterior bag panel (130). In some embodiments, the anterior bag panel (110), the expansion bag panel (150), and the posterior bag panel (130) are flexibly rolled into a cylindrical form for transport. In some embodiments, the anterior bag panel (110), the expansion bag panel (150), and the posterior bag panel (130) are held into a rolled-up position via the attachment strap (128) connecting to the attachment pad (148).

In some embodiments, two or more expansion bag panels (150) are located between the anterior bag panel (110) and the posterior bag panel (130).

In some embodiments, a plurality of pairs of holding straps (124) is located on a plurality of axes located on the anterior bag panel front surface (111).

In some embodiments, a wash cloth (151) is located in the holding strap (124).

In some embodiments, dental floss (152) is located in the holding strap (124).

In some embodiments, a shower cap (153) is located in the holding strap (124).

In some embodiments, a flexible bottle (154) is located in the holding strap (124). In some embodiments, the flexible bottle (154) comprises a tapered bottle mid-section (155) for easy securing by the holding strap (124). In some embodiments, the flexible bottle is able to be squeezed so that any interior side can be touched by an opposing interior side.

In some embodiments, a plurality of flexible bottles (154) is located in the holding straps (124). In some embodiments, liquid toiletry products are located in the flexible bottles (154). In some embodiments, the liquid toiletry products are selected from a group consisting of the following: mouth wash, shaving cream, body wash, hand sanitizer, shampoo, hair conditioner, hair spray, hair gel, hair remover, and hair mousse.

In some embodiments, a combined comb and brush (156) is located in the holding strap (124). In some embodiments, a comb is located opposed to a brush head. In some embodiments, the comb and brush (156) share a common handle.

In some embodiments, the combined comb and brush (156) are flexible. In some embodiments, a bottom tip of the combined comb and brush handle can be flexed to contact a top tip of the combined comb and brush (156).

In some embodiments, a toothbrush (157) is located in the holding strap (124). In some embodiments, a portion of toothpaste is pre-located in a center of bristles of the toothbrush (157). In some embodiments, the toothbrush (157) is flexible. In some embodiments, a bottom tip of the toothbrush (157) can be flexed to touch a top tip of the toothbrush (157).

In some embodiments, the holding strap (124) is elastic.

In some embodiments, the holding strap (124) comprises an adjustment mechanism.

In some embodiments, a stick of deodorant (158) is located in the holding strap (124).

In some embodiments, a razor (159) is located in the holding strap (124).

In some embodiments, a plurality of pairs of holding straps (124) is located on a plurality of axes located on the posterior bag panel front surface (131).

As used herein, the term "about" refers to plus or minus 10% of the referenced number.

The disclosures of the following U.S. Patents are incorporated in their entirety by reference herein: U.S. Pat. No. D 641,547; U.S. Pat. No. D 564,218; U.S. Patent Pub. No. 2004/0222125; U.S. Pat. No. 7,617,828; U.S. Pat. No. 6,935,783; U.S. Pat. No. 5,679,421; U.S. Pat. No. 5,524,778; U.S. Pat. No. 4,850,730; and U.S. Pat. No. 4,464,835.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. Reference numbers recited in the claims are exemplary and for ease of review by the patent office only, and are not limiting in any way. In some embodiments, the figures presented in this patent application are drawn to scale, including the angles, ratios of dimensions, etc. In some embodiments, the figures are representative only and the claims are not limited by the dimensions of the figures. In some embodiments, descriptions of the inventions described herein using the phrase "comprising" includes embodiments that could be described as "consisting of", and as such the written description requirement for claiming one or more embodiments of the present invention using the phrase "consisting of" is met.

The reference numbers recited in the below claims are solely for ease of examination of this patent application, and are exemplary, and are not intended in any way to limit the scope of the claims to the particular features having the corresponding reference numbers in the drawings.

What is claimed is:

1. An expandable travel bag system (100) to aid in organizing toiletries when travelling, wherein the system (100) comprises:

(a) a flexible, planar anterior bag panel (110) having an anterior bag panel front surface (111), an anterior bag panel rear surface (112), an anterior bag panel top edge (113), an anterior bag panel bottom edge (114), an anterior bag panel first edge (115), and an anterior bag panel second edge (116), wherein a first anterior flap (120) is disposed on the anterior bag panel top edge (113), wherein a second anterior flap (121) is disposed on the anterior bag panel bottom edge (114), wherein a second anterior hook and loop component (123) is disposed on the entire anterior bag panel second edge (116), wherein a pair of item holding straps (124) is disposed on the anterior bag panel front surface (111), wherein the holding straps (124) are disposed only in pairs only on an axis parallel to the anterior bag panel first edge (115) and the anterior bag panel second edge (116) on the anterior bag panel front surface (111), wherein an attachment strap (128) is disposed on the anterior bag panel rear surface (112), wherein the attachment strap (128) comprises a first hook and loop component (125) disposed thereon; and (b) a posterior bag panel (130) having a posterior bag panel front surface (131), a posterior bag panel rear surface (132), a posterior bag panel top edge (133), a posterior bag panel bottom edge (134), a posterior bag panel first edge (135), and a posterior bag panel second edge (136), wherein a first posterior flap (140) is disposed on the posterior bag panel top edge (133), wherein a second posterior flap (141) is disposed on the posterior bag panel bottom edge (134), wherein a first posterior hook and loop component (142) is disposed on the entire posterior bag panel first edge (135), wherein a pair of item holding straps (124) is disposed on the posterior bag panel front surface (131), wherein the holding straps (124) are disposed only in pairs only on an axis parallel to the posterior bag panel first edge (135) and the posterior bag panel second edge (136) on the posterior bag panel front surface (131), wherein an attachment pad (148) is disposed on the posterior bag panel rear surface (132), wherein the attachment pad (148) comprises a mated second hook and loop component (145) disposed thereon;

wherein the anterior bag panel (110) is disposed on the posterior bag panel (130) via the second anterior hook and loop component (123) attached to the first posterior hook and loop component (142), wherein the anterior bag panel (110) and the posterior bag panel (130) are flexibly rolled into a cylindrical form for transport, wherein the anterior bag panel (110) and the posterior bag panel (130) are held into a rolled-up position via the attachment strap (128) connecting to the attachment pad (148).

2. The system (100) of claim 1, wherein an expansion bag panel (150) is disposed between the anterior bag panel (110) and the posterior bag panel (130), wherein the anterior bag panel (110), the expansion bag panel (150), and the posterior bag panel (130) are flexibly rolled into a cylindrical form for transport, wherein the anterior bag panel (110), the expansion bag panel (150), and the posterior bag panel (130) are held into a rolled-up position via the attachment strap (128) connecting to the attachment pad (148).

3. The system (100) of claim 2, wherein two or more expansion bag panels (150) are disposed between the anterior bag panel (110) and the posterior bag panel (130).

4. The system (100) of claim 1, wherein a plurality of pairs of holding straps (124) is disposed on a plurality of axes disposed on the anterior bag panel front surface (111).

5. The system (100) of claim 1, wherein a wash cloth (151) is disposed in the holding strap (124).

6. The system (100) of claim 1, wherein dental floss (152) is disposed in the holding strap (124).

7. The system (100) of claim 1, wherein a shower cap (153) is disposed in the holding strap (124).

8. The system (100) of claim 1, wherein a flexible bottle (154) is disposed in the holding strap (124), wherein the flexible bottle (154) comprises a tapered bottle mid-section (155) for easy securing by the holding strap (124).

9. The system (100) of claim 8, wherein a plurality of flexible bottles (154) is disposed in the holding straps (124), wherein liquid toiletry products are disposed in the flexible bottles (154), wherein the liquid toiletry products are selected from a group consisting of the following: mouth wash, shaving cream, body wash, hand sanitizer, shampoo, hair conditioner, hair spray, hair gel, hair remover, and hair mousse.

10. The system (100) of claim 1, wherein a combined comb and brush (156) is disposed in the holding strap (124), wherein a comb is disposed opposed to a brush head, wherein the comb and brush (156) share a common handle, wherein the combined comb and brush (156) are flexible, wherein a bottom tip of the combined comb and brush handle can be flexed to contact a top tip of the combined comb and brush (156).

11. The system (100) of claim 1, wherein a toothbrush (157) is disposed in the holding strap (124), wherein a portion of toothpaste is pre-disposed in a center of bristles of the toothbrush (157), wherein the toothbrush (157) is flexible, wherein a bottom tip of the toothbrush (157) can be flexed to touch a top tip of the toothbrush (157).

12. The system (100) of claim 1, wherein the holding strap (124) is elastic.

13. The system (100) of claim 1, wherein the holding strap (124) comprises an adjustment mechanism.

14. The system (100) of claim 1, wherein a stick of deodorant (158) is disposed in the holding strap (124).

15. The system (100) of claim 1, wherein a razor (159) is disposed in the holding strap (124).

16. The system (100) of claim 1, wherein a plurality of pairs of holding straps (124) is disposed on a plurality of axes disposed on the posterior bag panel front surface (131).

* * * * *